US005199475A

United States Patent [19]

Koeder

[11] Patent Number: 5,199,475

[45] Date of Patent: Apr. 6, 1993

[54] DEVICE FOR SHAPING CURVED COMPONENTS

[75] Inventor: Paul Koeder, Ellwangen, Fed. Rep. of Germany

[73] Assignee: Koeder Ingenieurbuero und Sondermaschinen, Ellwangen, Fed. Rep. of Germany

[21] Appl. No.: 833,043

[22] Filed: Feb. 10, 1992

[30] Foreign Application Priority Data

Feb. 8, 1991 [DE] Fed. Rep. of Germany ..... 4103893

[51] Int. Cl.[5] ..... B27H 1/00; B27D 1/00

[52] U.S. Cl. ..... 144/256.1; 144/269; 144/349; 156/443; 156/583.8; 269/58; 269/216; 269/225

[58] Field of Search ..... 144/256.1, 259, 263, 144/267, 269, 270, 349; 156/443, 383.8; 269/56, 58, 216, 225; 100/41, 913

[56] References Cited

U.S. PATENT DOCUMENTS

| | | | |
|---|---|---|---|
| 927,925 | 7/1909 | Kaufman et al. | 144/256.1 |
| 1,561,613 | 11/1925 | McKeown | 144/256.1 |
| 2,331,927 | 10/1943 | Greevy | 144/256.1 |
| 2,399,348 | 4/1946 | Hobbs . | |
| 4,711,281 | 12/1987 | Kessel et al. | 144/256.1 |

FOREIGN PATENT DOCUMENTS 3641270 6/1988 Fed. Rep. of Germany .

OTHER PUBLICATIONS

Von Friedrich Fessel; *Maschinen zur spanlosen Holzformung;* Apr. 1952.

*Primary Examiner*—W. Donald Bray

*Attorney, Agent, or Firm*—Sixbey, Friedman, Leedom & Ferguson

[57] ABSTRACT

A device for shaping an optionally pressing curved components, such as curved beams of glued laminated girders, is provided which, in a modular type of construction, comprises at least two clamping devices on a base, which are movable. Each clamping device has, as a foundation, a slide that is movable along guides which, for example, are movable with rollers along a pair of rails as guides. In the central part of the slide, a rotary table is rotatable around an axis perpendicular to the slide, on which at least two adjustable clamping elements, symmetrical to the axis of rotation, are provided. To adjust these clamping elements, which can be formed by tighteners, an adjusting device is placed centered on the slide. With this adjusting device, the tighteners are moved toward, and away from, each other symmetrically relative to the axis of rotation in their opposite arrangement. A manual control or a computer-aided control can be used to control the device.

20 Claims, 5 Drawing Sheets

DEVICE FOR SHAPING CURVED COMPONENTS

BACKGROUND OF THE INVENTION

The invention relates to a device for shaping curved components, in particular glued laminated girders, curved beams or the like with at least two adjustable clamping devices.

A bending device of the above-mentioned type is known from U.S. Pat. No. 2,399,348. This bending device comprises a stationary part for the production of the bending shape of the part to be bent, which is designed preferably cylindrically or at least has a curved surface on the opposite sides. As a counterpart to this, a complementary component that has the shape of a slide and is movable is used, in which the actual bending shape of the part to be bent is determined by the space between the stationary and the movable shaped part of the bending device. These separate shaped and countershaped parts of the bending device have to be produced not only separately, but they also have to be adjusted to the desired positions in the bending process to be performed in each case. These adjusting procedures are time-consuming, and in addition, an important material and time expense is necessary for the production of the shaped and countershaped parts determining the bending shape.

For shaping and pressing curved beams designed as glued laminated girders, it was previously necessary to use corner brackets, against which the beams were pressed with screw clamps. For production of bent components, these corner brackets, which are anchored in a concrete bed, are placed so that, e.g. an arrangement with several corner brackets is comprised, which are placed in a type of a template curved corresponding to the component to be produced. The alignment and arrangement of the corner brackets for forming such a template are time-consuming, and the procedures required for this purpose have to be performed by hand. Therefore, the production of curved components, in particular curved beams in the shape of glued laminated girders, has previously been labor-intensive and expensive, since this can be called in almost every case special purpose and single-unit production. Also, the procedures respectively to be carried out in this case require experience and knowledge, so that experienced and trained personnel have to be used for these procedures. A special drawback in the previous production method is further to be seen in that the basic elements for the bent components to be produced can be provided most economically in a mechanical and even fully automatic way, so that with shaping and pressing of these components to the desired bent shape, the continuous production method for the basic components has to be interrupted.

SUMMARY OF THE INVENTION

The object of the present invention is to provide a device for shaping curved components of the general type noted, which permits a simplified production of curved components with a selectable curve and any length.

According to the invention, this object is achieved with a device for shaping curved components, in particular glued laminated girders, curved beams or the like, With the device according to the invention, any curved components, such as curved beam parts designed as glued laminated girders, can be produced in a basically simplified and economical way, since the slides of the clamping devices being used as foundations can be conveyed to the desired points while producing the respectively desired curve of the component to be produced, and the rotary tables mounted on them with at least two adjustable clamping elements are aligned with the component that is inserted and to be bent automatically in the necessary angular position. The clamping elements can be opened and closed in any position of the slide, so that optionally various pressing forces can be exerted on the component to be produced. This device permits, in an almost universal way, the production of components with any curvatures, without time-consuming and complicated alignment procedures for the respective clamping devices. Also, the number of clamping devices used according to the invention in the device for shaping curved components can be matched to the respectively desired purposes and, thanks to a modular type of construction, increased almost at random. As a result, it is also achieved that the lengths of the curved components to be produced are freely selectable.

The device according to the invention is not only suitable in a special way in the field of production of plywood and, for example, for shaping glued laminated girders in the production of components for housing construction such as door frames, window lintels, dormers, rafters, etc., of forms for concrete structures, of components for conservatories, pavilions, pergolas, garages, playgrounds, etc., but also shapings with other materials having similiar elasticity moduli can be achieved with this device, such as is the case, for example, in making welding designs from steel components.

Preferably, the guides for the movable slides are placed parallel to one another, and they are suitably provided in this arrangement on a base, so that the clamping devices, can be moved independent of one another, into the respectively desired position. Preferably, the device comprises a common drive device for moving the slides of the clamping devices, for which motors, chain drives and the like, for example, can be provided on the base of the device, so that the procedures for the respective positioning of the slides of the clamping devices can be performed simply and quickly also with untrained and inexperienced personnel.

To guide the slide of each clamping device, slip-in guides or guide rollers or else combinations of them can be used, and the respective guide method of course also is dependent on the required production accuracy of the components to be produced as well as their size and/or length. It has proven especially preferable to make the slides of the clamping devices movable on rollers along the guides, which suitably are designed as guide rails.

Preferably, the clamping elements, adjustable symmetrically to the axis of rotation, of the respective clamping device are formed by tighteners, so that with the shaping of the component to be produced, if the parallel clamping devices are moved, the component can roll off on these tighteners and there is a line contact of the clamping devices and the part to be produced to avoid possibly visible bending marks on the surface of the part to be produced.

Although the adjusting device for the clamping elements can also be respectively operated by motor with an electric, hydraulic, or pneumatic drive, it has proven suitable to make the centrically provided adjusting device for the clamping elements mechanically resistant and strudy, so that it comprises a chain wheel pinion with a gear-wheel transmitting device for symmetrical adjustment of the clamping elements relative to the axis of rotation of the slide. As a result, the respective necessary clamping forces can be varied and matched in an individual way.

A basic configuration of a device according to the invention comprises, for example, seven adjustable clamping devices of the above-mentioned type, and the most common lengths of the components to be bent can be shaped with such a device. The number of clamping devices of the device can optionally be increased. Preferably, to control the device, a manual control or a computer-aided control is provided. The manual control makes possible an individual input and presetting of the paths to be traversed and manipulated variables required for the production of the components, while a computer-aided control in particular permits a fully automatic operation of the device according to the invention with the lowest possible expenses for personnel. The computer-aided control can further be designed in a suitable way so that it can process information and data, such as CAD data, obtained directly in the design of the components to be produced and can determine from this the necessary adjustments to position the respective clamping devices of the device and its parts in a desirable way. In this way, an on-line operation, for example with a central computer, is possible for the design and the production.

In particular, the device has a modular structure, so that almost a universal flexibility for the shaping of the most varied embodiments of the components can be achieved.

According to a preferred embodiment, the clamping devices are movable independent of one another. But, as a function of the respective application, the clamping devices also, optionally, can be moved in a predetermined order and their movement coupled to one another.

Preferably, the clamping devices are placed in a common plane, which is formed by the guides provided in parallel for the movement of the slides of the clamping device.

In doing so, it is achieved that in the production of the components to be shaped, in particular also the desired high accuracy with respect to the planeness of the component is achieved in a structurally simple way.

These and other objects, features and advantages of the present invention will be apparent from the following detailed description of a preferred embodiment when it is considered in conjunction with the accompanying drawings.

BRIEF DESCRIPTION OF THE DRAWINGS

In the figures of the drawing, same or similar parts are provided with the same reference numerals.

DETAILED DESCRIPTION OF THE PREFERRED EMBODIMENT

Figure 1:
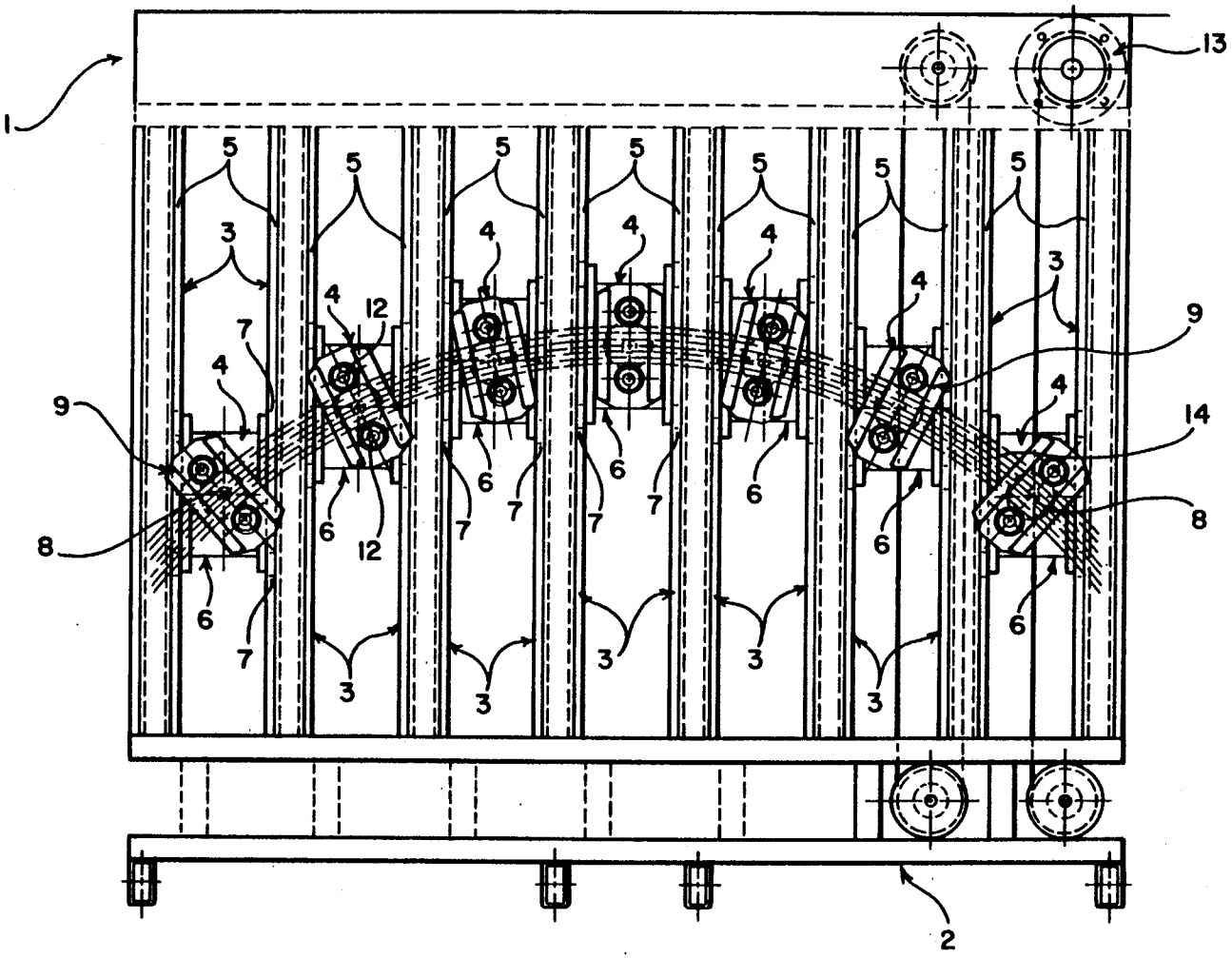
FIG. 1 is a diagrammatic top view of a preferred embodiment of a device for shaping and pressing a glued laminated girder for the production of a curved beam part.
Figure 2:
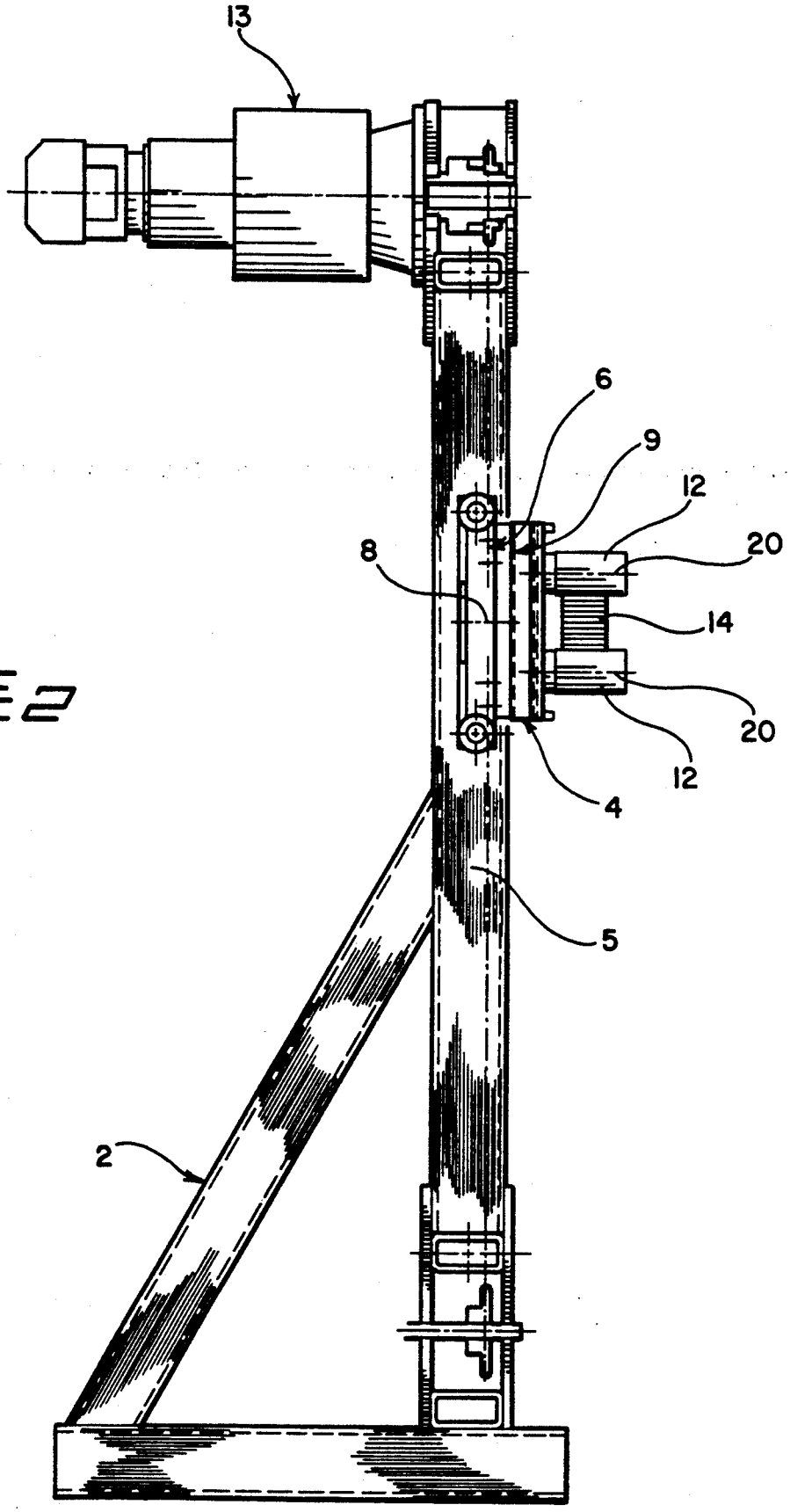
FIG. 2 is a side view of the device according to FIG. 1.

With reference to FIGS. 1 and 2, a device for shaping and pressing curved components is explained based on an example for the production of a curved beam made from a glued laminated girder. The device as a whole is designated there by reference numeral 1. In the illustrated embodiment, eight guides 3, for a total of seven clamping devices 4, are attached to a base 2 of device 1. Guides 3 are formed by rails 5 provided that are parallel to each other and clamping devices 4 are movable along these guides independent of one another. Each clamping device 4 has a base that is movable along guides 3, and which is designed as a slide 6 which is movable on rollers 7 along the rails 5 being used as guides 3. This slide 6 has a central axis 8. A rotary table 9 is rotatably mounted around this central axis 8, i.e., it is rotatably mounted centered on slide 6 around a perpendicular or, in FIG. 1, a vertical axis.

On rotary table 9, clamping elements 10 are provided symmetrically and diametrically opposite with respect to axis of rotation 8, and can be adjusted on rotary table 9 by a shifting movement. With an adjusting device that is placed centered and designated overall with 11, clamping elements 10 can be moved toward one another or away from one another to change the distance between them to open or close the clamping device. In the illustrated embodiment, clamping elements 10 are formed by two tighteners 12 in a diametrically opposite arrangement. With a drive device 13, which is formed by a motor-driven chain drive in the illustrated embodiment, slides 6 are moved individually along guides 3. Naturally, also drive devices other than represented drive device 13 can be used to move slides.

Device 1, explained above, has basically the mode of operation described in more detail below.

As a function of the desired curved shape of the component to be produced, such as a curved beam 14, which is designed as a glued laminated girder and has a straight shape in its orginal form, if it is inserted in the basic position of clamping devices 4 (not shown), slides 6 are moved with drive device 13 by an optionally provided control, not shown in more detail, to the desired positions. Suitably, clamping elements 10 of clamping devices 4 are still at least partially open, until slides 6 occupy their intended position. Beam 14 can then roll on tighteners 12 as the slides are brought into position to achieve the desired curved shape of beam 14, shown, for example, in FIG. 1. In this transport movement of slide 6, respective rotary tables 9 angularly align themselves with respect to the component to be bent, such as beam 14. Optionally, slides 6 can be stopped in the intended end position on guides 3 and be immovably fixed. With centrally placed adjusting device 11, which can be formed, for example, from a chain wheel pinion 15, clamping elements 10 are then moved toward one another relative to central axis 8, so that clamping elements 10 rest with a predetermined pressure force on beam part 14 curved in an arc shape with regard to the thickness of beam part 14.

Once shaping and pressing processing has been completed according to the processing time necessary in each case, clamping devices 4 can be opened by adjusting clamping elements 10 in the opening direction, and clamping elements 10 can be moved in the direction away from one another, so that finished-bent beam part 14 can be removed from device 1. The number of seven clamping devices 4 is thus geared to a length of beam part 14 of average size. Device 1 can naturally be optionally increased by the modular structure with respective clamping devices 4 and guides 3 assigned to them. A flexible matching also is possible taking into consideration different components to be produced with various curves each time in a structurally simple way.

The respectively used control for device 1 can be selected as a function of the desired degree of integration of device 1 in the overall production sequence in the production of plywood as well as considering the respective machinery. This control can be formed by a manual control or an automatic control, such as a computer-aided control. Such a computer-aided control of device 1 can even make possible a direct input and processing of information and data provided in the design, if, for example, the so-called Computer Aided Design (CAD) method is used. In this way, in providing drawings of individual parts, for example, data obtained from the structural engineer or architect can be used directly as input data for the control of device 1.

Device 1 for shaping and optionally pressing curved components makes possible a quick, economical production of components, curved in any way, made from various materials. Device 1 can be used easily and has a stable design comprising several, individual modular structural units. The considerable saving of time in the production of curved components by using device 1 represents an important advantage of device 1.

Figure 3:
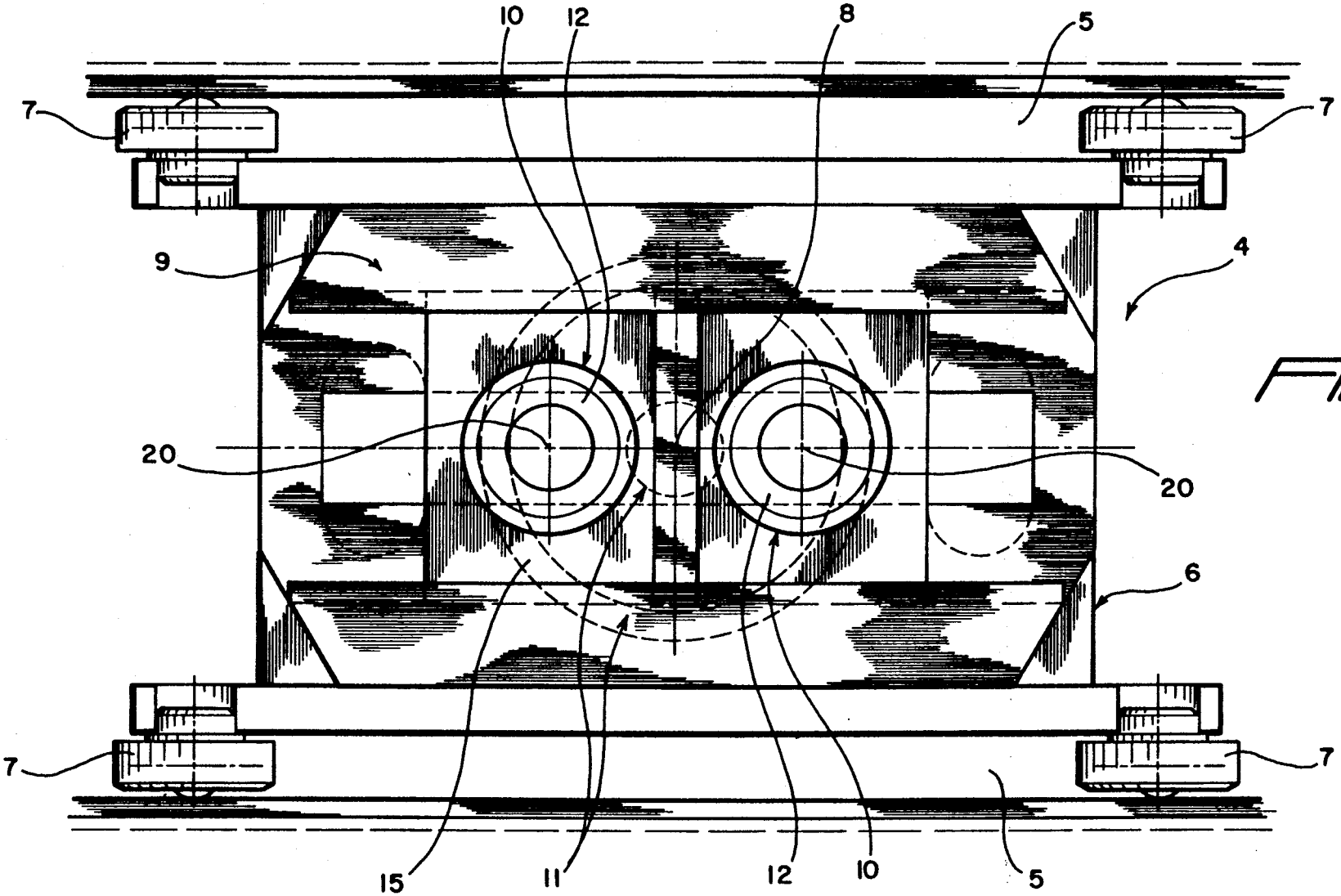
FIG. 3 is a top view of a clamping device according to the invention as a representation of an individual part.
Figure 4:
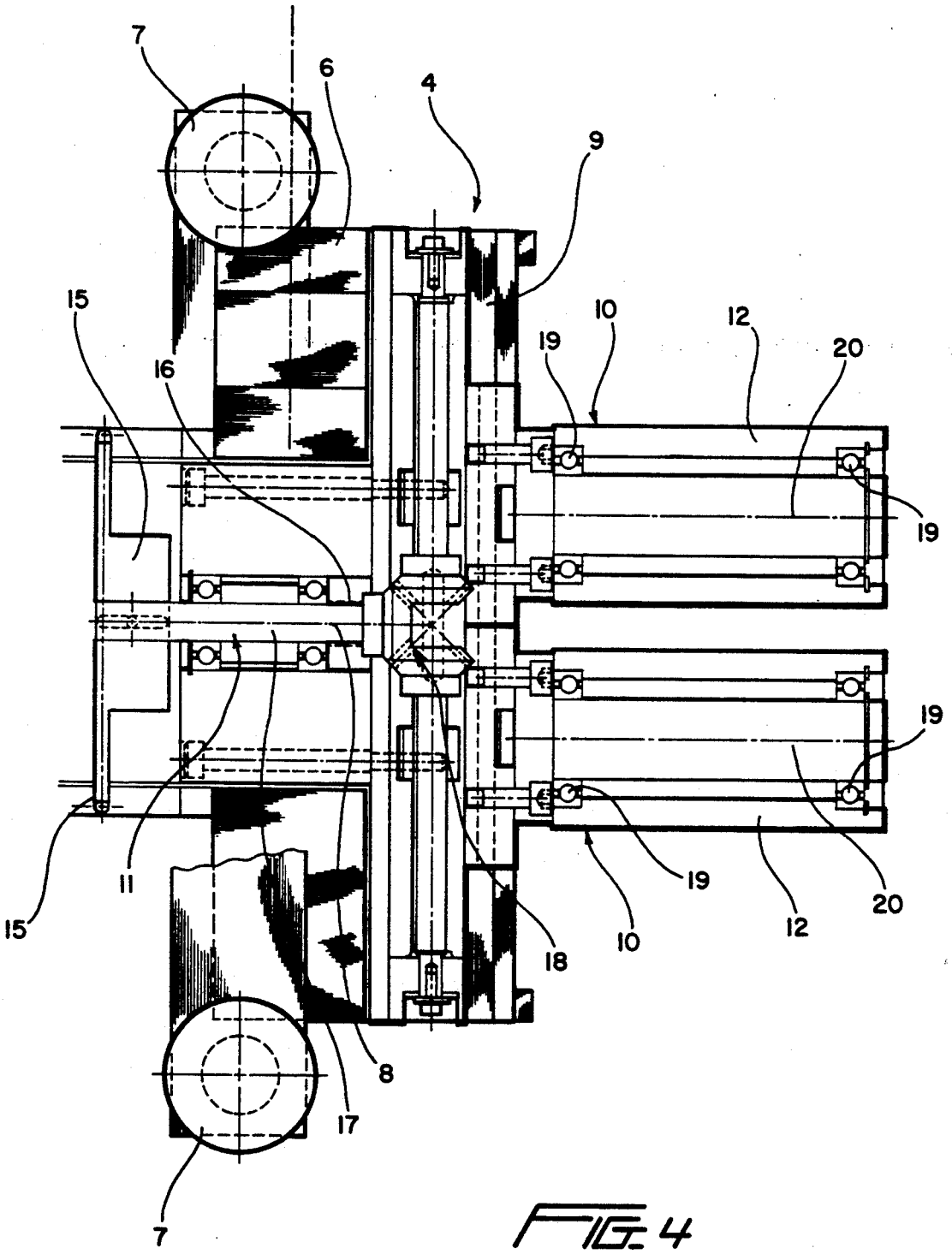
FIG. 4 is a side view of the clamping device according to FIG. 3 in a partial section representation.
Figure 5:
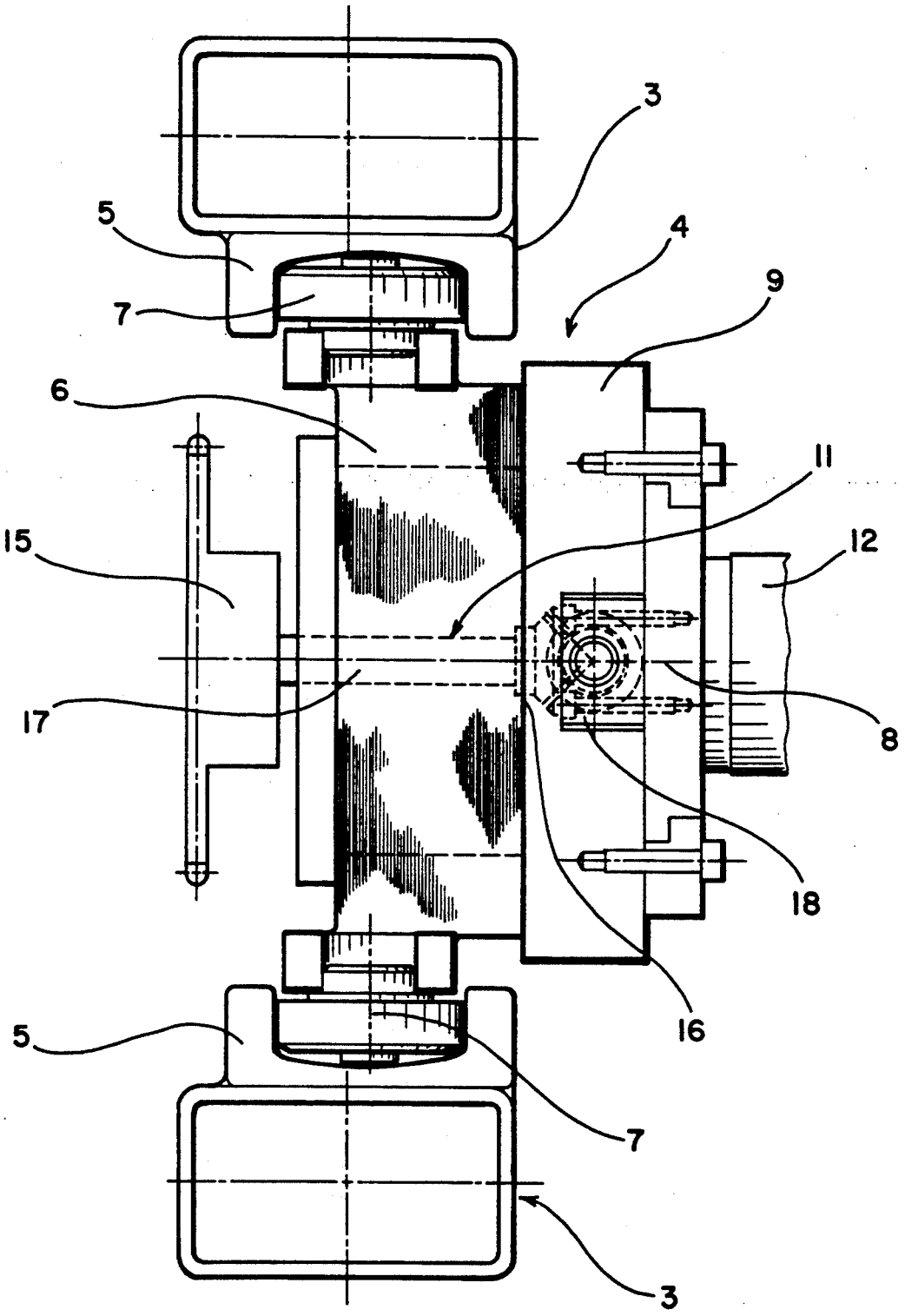
FIG. 5 is a side view of the clamping device according to FIG. 3.

With reference to FIGS. 3 to 5, more precise particulars of a respective clamping device 4 are illustrated in more detail. As is illustrated in FIG. 5, rollers 7 of slides 6, being used as a foundation of clamping device 4, each run in a pair of parallel rails 5 which form lengthwise guides 3 for slides 6. For this purpose, for example, four rollers 7 are provided on each slide 6. On slides 6, rotary table 9 is rotatably mounted around central axis 8. In diametrically opposite arrangement on central axis 8, two tighteners 12 are mounted on rotary table 9 symmetrically shiftable along assigned guides. As an adjusting device 11, chain wheel pinion 15 is provided with an adjusting spindle part 16 on its spindle 17 and a centrically placed gear-wheel transmitting device 18, which is accommodated in rotary table 9, so that in a rotatary movement of chain wheel pinion 15 by gear-wheel transmitting device 18, an adjusting movement is imparted along their guides to tighteners 12, on rotary table 9. By this adjusting device 11, tighteners 12 can be moved in a direction toward, or away from, one another to achieve the desired clamping of the component to be produced.

The detail explained and shown based on FIGS. 3 to 5 represents, for example, a module of a device, designated overall with 1, for shaping curved components 14. With ball bearings 19, tighteners 12 are rotatable around their own axis 20, so that the component to be produced can roll off on tighteners 12. A corresponding adjusting drive can drive, by gear-wheel transmitting device 18, respective tighteners 12 to perform a movement along these guides. Respective clamping devices 4 are designed so that they have a sufficient inherent rigidity to be able to achieve the desired accuracy in components 14 to be produced. Device 1 as a whole is made sturdy and resistant.

While only a single embodiment has been shown and described, numerous modifications and changes thereto, as well as embodiments that are equivalent thereto will be apparent to those skilled in the art from the foregoing. Thus, the present invention should not be viewed as limited to the specifics shown and described herein and is intended to encompass the full scope of the appended claims.

I claim:

1. Device for producing shaping curved components having at least two adjustable clamping devices, wherein each clamping device comprises:
   a) a slide that is movable along guides, said slide functioning as a base of the clamping device;
   b) a rotary table which is rotatably mounted for rotation around a central axis of rotation;
   c) at least two adjustable clamping elements arranged on the rotary table symmetrically with respect to the axis of rotation on opposite sides thereof; and
   d) a centrically placed adjusting device connected to the clamping elements for changing the distance between the clamping elements for opening and closing the clamping device.

2. Device according to claim 1, wherein the guides for the movable slides are placed parallel to one another.

3. Device according to claim 2, wherein the guides are provided on a base.

4. Device according to claim 3, wherein a common drive device is provided to move the slides.

5. Device according to claim 3, wherein the slide is mounted to slide on the guides.

6. Device according to claim 3, wherein the slide is movable along the guides on rollers.

7. Device according to claim 1, wherein the clamping elements are formed by clamping rollers.

8. Device according to claim 7, wherein said adjusting device for the clamping elements comprises a chain wheel pinion with a gear-wheel transmitting device for symmetrical adjustment of the clamping elements relative to the axis of rotation of the rotary table and central axis of the slide.

9. Device according to claim 7, wherein the device comprises an arrangement with seven adjustable clamping devices.

10. Device according to claim 7, wherein a manual control is provided to control device.

11. Device according to claim 1, wherein the device has a modular construction.

12. Device according to claim 8, wherein the clamping devices are movable independent of one another.

13. Device according to claim 8, wherein clamping devices are placed in a common plane.

14. Device according to claim 1, wherein the clamping devices are movable independent of one another.

15. Device according to claim 1, wherein clamping devices are placed in a common plane.

16. Device according to claim 1, wherein an adjusting device for the clamping elements comprises a chain wheel pinion with a gear-wheel transmitting device for symmetrical adjustment of the clamping elements relative to the axis of rotation of the rotary table and central axis of the slide.

17. Device according to claim 16, wherein the device comprises an arrangement with seven adjustable clamping devices.

18. Device according to claim 17, wherein a manual control is provided to control said device.

19. Device according to claim 1, wherein the device comprises an arrangement with seven adjustable clamping devices.

20. Device according to claim 19, wherein a manual control is provided to control said device.

* * * * *